US010146149B2

(12) United States Patent
Watanabe et al.

(10) Patent No.: US 10,146,149 B2
(45) Date of Patent: Dec. 4, 2018

(54) CHARGING MEMBER, ELECTROPHOTOGRAPHIC PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Hiroaki Watanabe, Odawara (JP); Takumi Furukawa, Susono (JP); Yuya Tomomizu, Yokohama (JP); Kenya Terada, Suntou-gun (JP); Toshiro Suzuki, Gotemba (JP); Kenichi Yazawa, Suntou-gun (JP); Kazuhiro Gesho, Kariya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/955,260

(22) Filed: Apr. 17, 2018

(65) Prior Publication Data

US 2018/0314180 A1 Nov. 1, 2018

(30) Foreign Application Priority Data

Apr. 27, 2017 (JP) ..... 2017-088610

(51) Int. Cl.
*G03G 15/02* (2006.01)

(52) U.S. Cl.
CPC ..... *G03G 15/0233* (2013.01); *G03G 15/0225* (2013.01)

(58) Field of Classification Search
CPC ..... G03G 15/0233; G03G 15/0216; G03G 15/0225; G03G 2215/021
See application file for complete search history.

(56) References Cited

U.S. PATENT DOCUMENTS

| | | | |
|---|---|---|---|
| 4,420,548 | A | 12/1983 | Sakai et al. |
| 5,198,685 | A | 3/1993 | Kitani et al. |
| 7,693,457 | B2 | 4/2010 | Kuruma et al. |
| 7,962,068 | B2 | 6/2011 | Kuroda et al. |
| 8,440,307 | B2 | 5/2013 | Nose et al. |
| 8,445,113 | B2 | 5/2013 | Furukawa et al. |
| 8,469,867 | B2 | 6/2013 | Kuroda et al. |

(Continued)

FOREIGN PATENT DOCUMENTS

JP 2008276024 A 11/2008

*Primary Examiner* — Sandra Brase
(74) *Attorney, Agent, or Firm* — Fitzpatrick Cella Harper and Scinto

(57) ABSTRACT

The charging member includes: an electroconductive support; and an electroconductive elastic layer serving as a surface layer, wherein the elastic layer contains a binder, and holds electrically insulating hollow particles in such a state that at least a part of each of the hollow particles is exposed at a surface of the elastic layer, wherein the charging member has protrusions derived from the hollow particles in an outer surface of the charging member, and the outer surface of the charging member includes an outer surface of the elastic layer and an outer surface of an exposed portion of each of the hollow particles, and wherein the protrusions each have a depression in an outer surface of each of the protrusions, and an edge of the depression constitutes an apex in each of the protrusions.

6 Claims, 4 Drawing Sheets

(56) References Cited

U.S. PATENT DOCUMENTS

| | | | | |
|---|---|---|---|---|
| 8,481,167 | B2 | 7/2013 | Watanabe et al. | |
| 8,491,994 | B2 | 7/2013 | Harada et al. | |
| 8,501,312 | B2 | 8/2013 | Harada et al. | |
| 8,501,325 | B2 | 8/2013 | Tomomizu et al. | |
| 8,503,911 | B2 | 8/2013 | Suzumura et al. | |
| 8,526,857 | B2 | 9/2013 | Tomomizu et al. | |
| 8,532,535 | B2 | 9/2013 | Nose et al. | |
| 8,538,298 | B2 | 9/2013 | Harada et al. | |
| 8,622,881 | B1 | 1/2014 | Harada et al. | |
| 8,685,601 | B2 | 4/2014 | Nose et al. | |
| 8,750,762 | B2 | 6/2014 | Harada et al. | |
| 8,755,714 | B2 | 6/2014 | Nagamine et al. | |
| 8,923,732 | B2 | 12/2014 | Harada et al. | |
| 8,991,053 | B2 | 3/2015 | Watanabe et al. | |
| 9,360,833 | B2 | 6/2016 | Terada et al. | |
| 9,372,428 | B2 | 6/2016 | Kuroda et al. | |
| 9,372,429 | B2 | 6/2016 | Watanabe et al. | |
| 9,904,199 | B2 | 2/2018 | Terada et al. | |
| 9,910,379 | B2 | 3/2018 | Furukawa et al. | |
| 2011/0305481 | A1* | 12/2011 | Taniguchi ..... | G03G 15/0233 399/115 |
| 2012/0076535 | A1 | 3/2012 | Nagamine et al. | |
| 2013/0004206 | A1 | 1/2013 | Kuroda et al. | |
| 2013/0034369 | A1 | 2/2013 | Masu et al. | |
| 2013/0064571 | A1 | 3/2013 | Kodama et al. | |
| 2015/0087489 | A1* | 3/2015 | Sato ..... | G03G 5/087 492/18 |
| 2015/0277244 | A1* | 10/2015 | Sato ..... | G03G 5/04 399/159 |
| 2018/0101107 | A1 | 4/2018 | Tomomizu et al. | |
| 2018/0120727 | A1 | 5/2018 | Masu et al. | |

* cited by examiner

CHARGING MEMBER, ELECTROPHOTOGRAPHIC PROCESS CARTRIDGE, AND ELECTROPHOTOGRAPHIC IMAGE FORMING APPARATUS

BACKGROUND OF THE INVENTION

Field of the Invention

The present disclosure relates to a charging member, and more particularly, to a charging member to be used for an electrophotographic image forming apparatus, and to an electrophotographic process cartridge and an electrophotographic image forming apparatus.

Description of the Related Art

In an electrophotographic image forming apparatus, such as a copying machine or a printer, a charging member is used as a unit configured to charge a photosensitive member. In addition, an increase in life of a process cartridge and a reduction in number of members have been demanded in order to reduce a printing cost and reduce an environmental burden. In order to satisfy those demands, it is important to suppress generation of image unevenness due to adhesion of toner, an external additive, or the like to the charging member. In Japanese Patent Application Laid-Open No. 2008-276024, there is disclosed a charging member having protrusions derived from resin particles in its surface. When the charging member having such protrusions is brought into contact with the photosensitive member serving as a body to be charged, a minute gap is formed in a nip portion between the charging member and the photosensitive member, and discharge is generated in the gap. It is described that the discharge makes uniform a charging failure that has occurred on an upstream side of the nip portion.

However, when the charging member having protrusions formed in its surface is used over a long period of time, contamination may accumulate on the surface to gradually change chargeability. In particular, when the contamination adheres to protrusions of a surface of a roller, a horizontal streak-like image failure may be liable to occur.

SUMMARY OF THE INVENTION

One aspect of the present disclosure is directed to providing a charging member capable of exhibiting stable charging performance even when used for a long period of time.

Another aspect of the present disclosure is directed to providing a manufacturing method of a charging member capable of exhibiting stable charging performance even when used for a long period of time. Another aspect of the present disclosure is directed to providing a process cartridge and an electrophotographic image forming apparatus that contribute to the formation of high-quality electrophotographic images.

According to one aspect of the present disclosure, there is provided a charging member, including: an electroconductive support; and an electroconductive elastic layer serving as a surface layer, wherein the elastic layer contains a binder, and holds electrically insulating hollow particles in such a state that at least a part of each of the hollow particles is exposed at a surface of the elastic layer, wherein the charging member has protrusions derived from the hollow particles in an outer surface of the charging member, and the outer surface of the charging member includes an outer surface of the elastic layer and an outer surface of an exposed portion of each of the hollow particles, wherein the hollow particles have an average diameter of hollow portions of each of the hollow particles of 7 μm or more and 100 μm or less, wherein the hollow particles have an average shell thickness of 0.05 μm or more and 3.00 μm or less, wherein the protrusions each have a depression in an outer surface of each of the protrusions, and an edge of the depression constitutes an apex in each of the protrusions, and wherein the depressions have an average depth of 1.0 μm or more and 6.0 μm or less.

According to another aspect of the present disclosure, there is provided an electrophotographic process cartridge, including the above-mentioned charging member, the electrophotographic process cartridge being removably mounted onto a main body of an electrophotographic image forming apparatus.

According to still another aspect of the present disclosure, there is provided an electrophotographic image forming apparatus, including at least the above-mentioned charging member, an exposing apparatus, and a developing apparatus.

According to still another aspect of the present disclosure, there is provided a manufacturing method for the above-mentioned charging member, the method including: preparing an unvulcanized rubber composition containing a rubber material serving as a binder, and thermally expandable microcapsule particles; and subjecting the unvulcanized rubber composition to extrusion molding onto an electroconductive support, and then vulcanizing the unvulcanized rubber composition through two-stage heating to form an electroconductive elastic layer serving as a surface layer.

Further features of the present disclosure will become apparent from the following description of exemplary embodiments with reference to the attached drawings.

DESCRIPTION OF THE EMBODIMENTS

Preferred embodiments of the present disclosure will now be described in detail in accordance with the accompanying drawings.

A charging member according to one aspect of the present disclosure includes an electroconductive support, and an electroconductive elastic layer serving as a surface layer (hereinafter sometimes referred to simply as "surface layer"). The elastic layer is, for example, arranged on the electroconductive support directly or through the intermediation of another layer.

The elastic layer is a layer constituting at least a part of the outer surface of the charging member. Therefore, when a plurality of layers are formed on the surface of the electroconductive support, the elastic layer is a layer located farthest away from the electroconductive support.

The elastic layer contains a binder. In addition, the elastic layer holds electrically insulating hollow particles in such a state that at least a part of each of the hollow particles is exposed from the elastic layer. Further, portions of the hollow particles exposed from the elastic layer form protrusions in the outer surface of the charging member. That is, the charging member has protrusions derived from the hollow particles in the outer surface of the charging member. Therefore, the outer surface of the charging member includes at least the outer surface of the elastic layer and the outer surface of the portion of each of the hollow particles exposed from the elastic layer.

In addition, an average value for the diameters of the hollow portions of each of the hollow particles is 7 μm or more and 100 μm or less. An average value for the shell thicknesses of the hollow particles is 0.05 μm or more and 3.00 μm or less.

Further, the protrusions each have a depression in the outer surface of the protrusion, and an edge portion of the depression constitutes an apex in the protrusion. Moreover, an average value for the depths of the depressions is 1.0 μm or more and 6.0 μm or less.

The depression is present in at least a part of the portion of each of the hollow particles exposed from the elastic layer, and the edge portion of the depression constitutes the apex in the protrusion. The apex in the protrusion refers to the highest portion of the protrusion. That is, the apex in the protrusion refers to a portion of the outer surface of the protrusion farthest away from the outer surface of the electroconductive support.

Figure 1A:
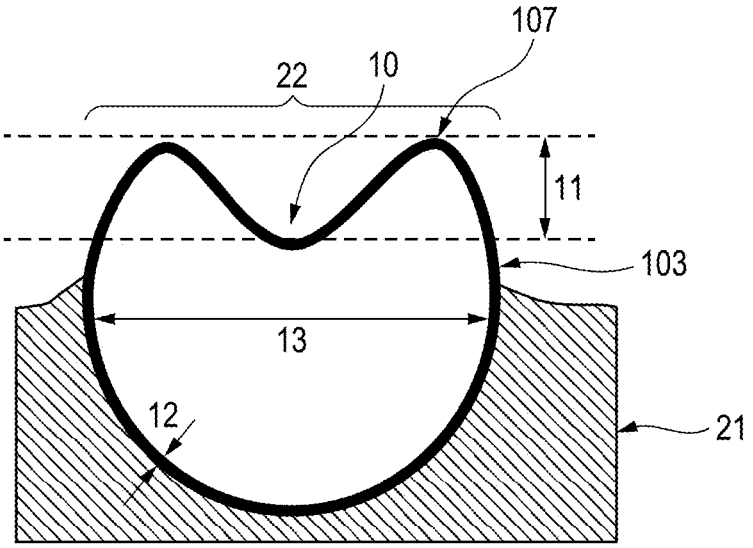
FIG. 1A is a schematic cross-sectional view of a hollow particle exposed at an elastic layer surface of a charging member according to the present disclosure.
Figure 1B:
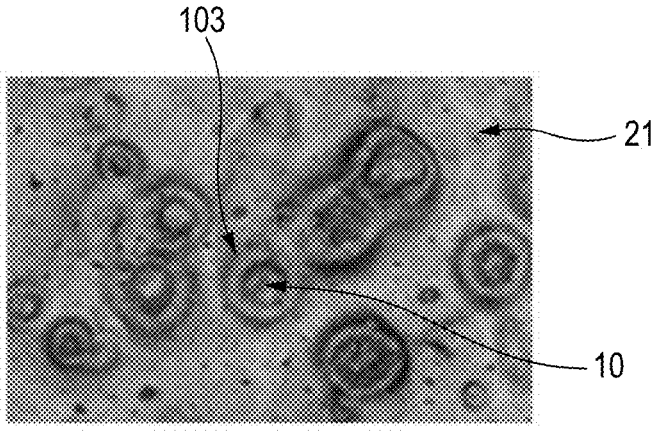
FIG. 1B is a micrograph of the elastic layer surface of the charging member according to the present disclosure.

In FIG. 1A, a cross-sectional view of a hollow particle 103 held by an elastic layer 21 in the charging member according to one aspect of the present disclosure is illustrated. In addition, in FIG. 1B, a micrograph of the surface of the charging member is shown.

The hollow particle 103 is held by the elastic layer 21 so that at least part thereof is exposed from the elastic layer. The portion of the hollow particle 103 exposed from the elastic layer forms a protrusion 22 in the surface of the charging member. The protrusion 22 has a depression 10 in its outer surface, and an edge portion 107 of the depression constitutes an apex in the protrusion 22. A depth 11 of the depression 10 is 1.0 μm or more and 6.0 μm or less on average. A thickness 12 of the shell of the hollow particle is 0.05 μm or more and 3.00 μm or less on average. In addition, a diameter 13 of the hollow portion is 7 μm or more and 100 μm or less on average. The diameter of the hollow portion is regarded as the diameter of a sphere having the same volume as the volume of the hollow portion.

The inventors of the present disclosure have assumed as follows with regard to a mechanism by which the charging member having such construction provides charging uniformity by eliminating contamination, such as toner or an external additive, even when the contamination adheres to the surface of the charging member and accumulates thereon. In FIG. 2A to FIG. 2D, schematic views for describing the mechanism are illustrated.

First, contamination, such as toner, an external additive, or paper dust, adhering to the surface of a photosensitive member may adhere to the charging member. In this case, the contamination is liable to adhere to the protrusions of the charging member because their distances from the photosensitive member are short. The protrusions are easily discharging portions in the surface of the charging member, and greatly influence the charging uniformity of the photosensitive member. When the contamination adheres to the protrusions to change their discharge characteristics, an electrophotographic image is greatly influenced.

Figure 2A:
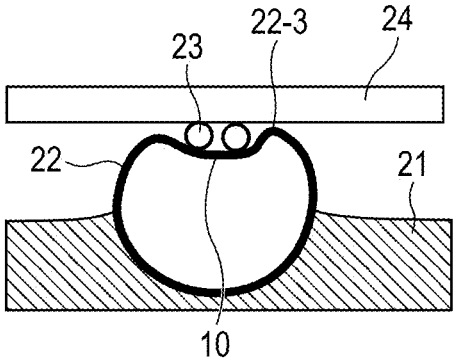
FIG. 2A, FIG. 2B, FIG. 2C, and FIG. 2D are schematic views for describing the contamination elimination mechanism of the hollow particle according to the present disclosure.

FIG. 2A is a cross-sectional view of the surface layer of the charging member in its thickness direction. At the surface of the charging member, a part of the hollow particle 103 is exposed to form the protrusion 22. The hollow particle 103 forming the protrusion has the depression 10 in its outer surface. An edge portion 22-3 of the depression 10 constitutes the apex in the protrusion 22, i.e., a portion farthest away from the outer surface of the electroconductive support (not shown).

When the charging member having such construction is brought into contact with an electrophotographic photosensitive member (hereinafter sometimes referred to simply as "photosensitive member") 24 to charge the photosensitive member 24, contamination 23 adhering to the surface of the photosensitive member 24 may adhere to the depression 10.

Then, the contamination 23 adhering to the depression 10 is hardly brought into pressure contact between the surface of the photosensitive member 24 and the surface of the protrusion 22 by virtue of a space between the depression 10 and the surface of the photosensitive member 24.

Figure 2C:
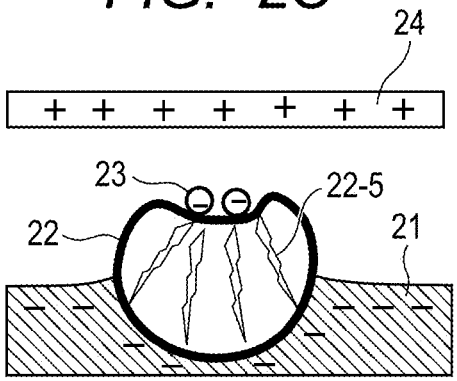
Figure 2B:
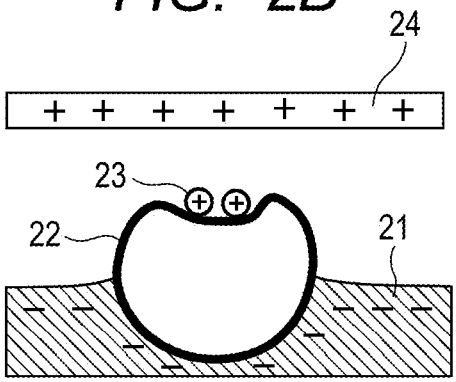

Most of the contamination adhering to the depression 10 is electrically insulative, and is charged to the opposite polarity to the polarity of a voltage applied to the charging member as a result of discharge that occurs between the charging member and the photosensitive member 24. That is, as illustrated in FIG. 2B, when the charging member is charged to relatively negative polarity and the photosensitive member 24 is charged to relatively positive polarity, the contamination 23 in contact with the charging member discharges negative charge to be charged to positive polarity as a result of discharge (discharge between the charging member and the photosensitive member 24).

Meanwhile, when the charging member is charged to relatively positive polarity and the photosensitive member 24 is charged to relatively negative polarity, the contamination 23 discharges positive charge to be charged to negative polarity. That is, the contamination 23 adhering to the charging member is charged to the opposite polarity to that of the charging member.

Figure 2D:
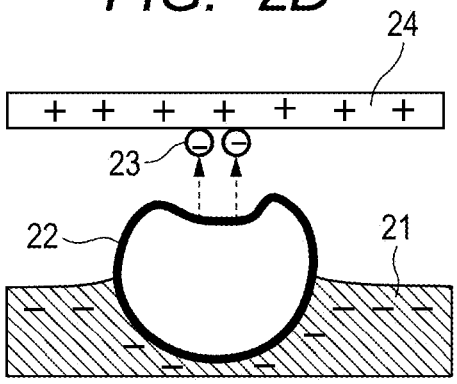

Accordingly, it is conceivable that the contamination 23 is liable to remain adhering to the depression and is hard to eliminate owing to an electrostatic attraction acting between the contamination 23 and the charging member. However, in the case of the charging member according to this aspect, the contamination 23 adhering to the depression 10 is eliminated. The reason for this is described below. That is, as illustrated in FIG. 2C, the protrusion 22 in the charging member according to this aspect is formed of the hollow particle having a specific hollow diameter and having a shell with a specific thickness. In this case, with respect to the contamination 23 adhering to the depression 10, discharge 22-5 is generated from the elastic layer 21 through the shell of the hollow particle to move charge to the contamination 23 in the depression 10, and hence the polarity of the contamination 23 and the polarity of the voltage applied to the charging member become the same polarity. As a result, a repulsion is considered to act between the contamination 23 and the charging member to eliminate the contamination 23 from the depression 10 as illustrated in FIG. 2D.

By virtue of the depression 10, even when the toner (contamination 23) adheres to the protrusion, the toner is hardly brought into pressure contact with the charging member. In addition, through the discharge in the hollow portion, electrically adhering matter can be eliminated toward the photosensitive member 24. As a result, the accumulation of the contamination 23 on the charging member can be suppressed, and stable charging performance can be maintained over a long period of time.

<Electrophotographic Image Forming Apparatus>

Figure 5:
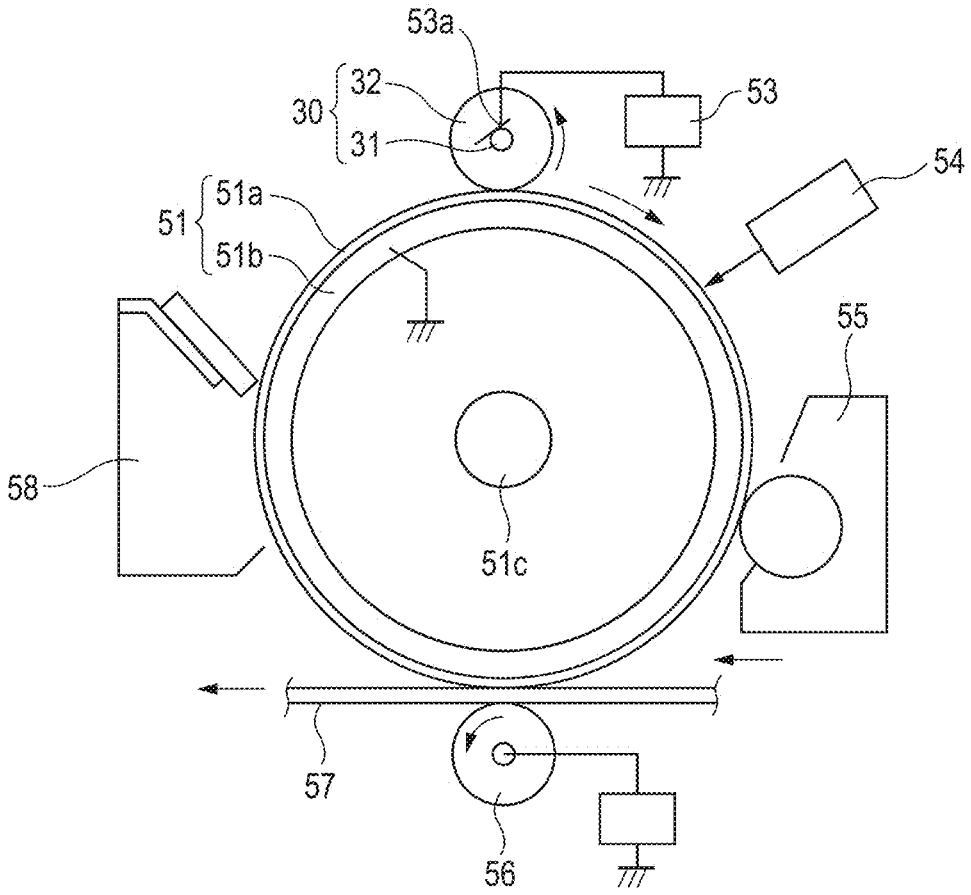
FIG. 5 is a schematic construction view of an example of an electrophotographic image forming apparatus including the charging member.

In FIG. 5, an example of an electrophotographic image forming apparatus including the charging member according to one aspect of the present disclosure is illustrated. An electrophotographic photosensitive member 51 is a drum-shaped electrophotographic photosensitive member including an electroconductive support 51*b* having electroconductivity, such as aluminum, and having a photosensitive layer 51*a* formed on the electroconductive support 51*b* as a basic constituent layer. The photosensitive member 51 is rotationally driven with a predetermined circumferential speed clockwise in the drawing surface about an axis 51*c*.

A charging apparatus includes a charging member 30, a power source 53, and a rubbing-friction power source 53*a*, and the surface of the photosensitive layer 51*a* is charged by the charging apparatus. The charging member 30 is a charging roller including a mandrel 31 and an electroconductive elastic layer 32, and both end portions of the mandrel 31 are pressed by a pressing unit (not shown) against the electrophotographic photosensitive member 51. In addition, when the electrophotographic photosensitive member 51 is rotated by a drive unit (not shown), the charging member 30 is rotationally driven as a result. A predetermined direct-current (DC) bias voltage is applied to the mandrel 31 from the power source 53 via the rubbing-friction power source 53*a*, and thus the electrophotographic photosensitive member 51 is charged to predetermined polarity and predetermined potential.

The electrophotographic photosensitive member 51 having its peripheral surface charged by the charging member is then subjected to exposure of image information of interest (laser beam scanning exposure, slit exposure of an original image, or the like) by an exposing apparatus 54, and thus electrostatic latent images corresponding to the image information of interest are formed on the peripheral surface.

The electrostatic latent images are sequentially visualized as toner images by a developing apparatus 55. The toner images are then sequentially transferred onto a transfer material 57 by a transfer unit 56. The transfer material 57 is taken from a sheet feeding unit (not shown) in synchronization with the rotation of the electrophotographic photosensitive member 51, and is conveyed at proper timing to a transfer portion between the electrophotographic photosensitive member 51 and the transfer unit 56. The transfer unit 56 in this example is a transfer roller, and is configured to charge the transfer material 57 from its back to the opposite polarity to that of the toner, to thereby transfer the toner images on the electrophotographic photosensitive member 51 side onto the transfer material 57. The transfer material 57 having the toner images transferred onto its surface is separated from the electrophotographic photosensitive member 51 and conveyed to a fixing unit (not shown), where the images are fixed, and is output as an image-formed product. Alternatively, when image formation is performed also on the back surface of the transfer material 57, the transfer material 57 is conveyed to a reconveying unit to the transfer portion. The peripheral surface of the electrophotographic photosensitive member 51 after the image transfer is subjected to pre-exposure by a pre-exposing unit (not shown) to remove (neutralize) residual charge on the electrophotographic photosensitive member drum. A known unit may be utilized for the pre-exposing unit, and suitable examples thereof may include an LED chip array, a fuse lamp, a halogen lamp, and a fluorescent lamp.

The neutralized peripheral surface of the electrophotographic photosensitive member 51 is turned to a clean surface through the removal of an adhering contaminant, such as transfer residual toner, by a cleaning apparatus 58, and is repeatedly used for image formation.

The charging member 30 may be driven by the electrophotographic photosensitive member 51, which is driven to move on a plane, or may be non-rotational.

In addition, when the electrophotographic image forming apparatus is used as a copying machine, the exposure may be performed with reflected light or transmitted light from an original. Alternatively, the original may be read to obtain a signal, and scanning with a laser beam or driving of an LED array may be performed based on the signal. Examples of the electrophotographic image forming apparatus include electrophotography-applying apparatus, such as a copying machine, a laser beam printer, an LED printer, and an electrophotographic plate making system.

The electrophotographic photosensitive member 51, the charging apparatus (including the charging member 30), the exposing apparatus 54, and the developing apparatus 55, and further, the cleaning apparatus 58 may be integrated to form an electrophotographic process cartridge removably mounted onto the main body of an electrophotographic image forming apparatus.

<Charging Member>

Figure 3:
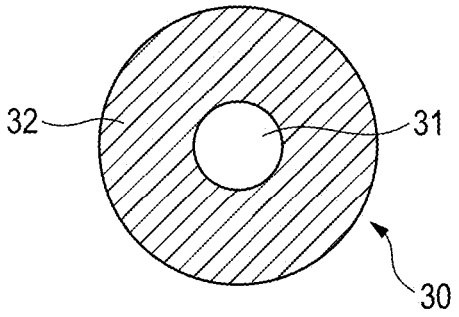
FIG. 3 is a schematic cross-sectional view for illustrating an example of the construction of the charging member according to the present disclosure.

An example of the charging member is illustrated in FIG. 3. The charging member 30 illustrated in FIG. 3 is a charging roller, and includes the mandrel 31 serving as an electroconductive support, and the electroconductive elastic layer 32 arranged on the outer periphery of the mandrel 31, that is, serving as a surface layer. Another electroconductive elastic layer may be arranged between the electroconductive elastic layer 32 and the mandrel 31. The charging member may be used as a charging member of the electrophotographic image forming apparatus illustrated in FIG. 5.

(Electroconductive Support)

The mandrel 31 serving as the electroconductive support only needs to: have electroconductivity; be capable of supporting the surface layer and the like; and be capable of maintaining strength as a charging member, typically as a charging roller. The electroconductivity of the electroconductive support may be appropriately set, and for example, may be appropriately set to a range known as the electroconductivity of the electroconductive support of a charging member for electrophotography.

(Electroconductive Elastic Layer Serving as Surface Layer)

The electroconductive elastic layer 32 serving as the surface layer may be formed of a binder and hollow particles. A material showing rubber elasticity may be used as the binder. As a rubber material that may be used for the binder, there are specifically given the following polymers: thermosetting rubber materials each obtained by blending a crosslinking agent into a raw material rubber, such as a natural rubber (NR), an isoprene rubber (IR), a butadiene rubber (BR), a styrene-butadiene rubber (SBR), a butyl rubber (IIR), an ethylene-propylene-diene terpolymer rubber (EPDM), an epichlorohydrin homopolymer (CHC), an epichlorohydrin-ethylene oxide copolymer (CHR), an epichlorohydrin-ethylene oxide-allyl glycidyl ether terpolymer (CHR-AGE), an acrylonitrile-butadiene copolymer (NBR), a hydrogenated product of an acrylonitrile-butadiene copolymer (H-NBR), a chloroprene rubber (CR), or an acrylic rubber (ACM or ANM); and thermoplastic elastomers, such as a polyolefin-based thermoplastic elastomer, a polystyrene-based thermoplastic elastomer, a polyester-based thermoplastic elastomer, a polyurethane-based thermoplastic elastomer, a polyamide-based thermoplastic elastomer, and a polyvinyl chloride-based thermoplastic elastomer. Further, a mixture obtained by blending those polymers may also be used. Of those, an acrylonitrile-butadiene rubber is preferred because the acrylonitrile-butadiene rubber is excellent in processability and most suited for extrusion molding.

As required, carbon black is blended as electroconductive particles into the surface layer. The carbon black may be blended in a blending amount adjusted so that the electrical resistance of the surface layer may have a desired value. The electroconductivity of the surface layer may be appropriately set, and for example, may be appropriately set to a range known as the electroconductivity of the surface layer of a charging member for electrophotography.

A preferred blending amount of the carbon black is from 20 parts by mass to 70 parts by mass with respect to 100 parts by mass of the binder polymer. When the blending amount is set to 20 parts by mass or more, a decrease in hardness of the surface layer can be suppressed to provide an appropriate hardness. In addition, when the blending amount of the carbon black is 70 parts by mass or less, an increase in hardness of the surface layer can be suppressed to provide an appropriate hardness. When the increase in hardness of the surface layer is suppressed, an abutting state between the surface layer and the photosensitive member is improved, and hence the occurrence of an image failure resulting from nonuniform adhesion of contamination, such as toner or paper dust, to the surface of the charging member during long-term use can be prevented.

The kind of the carbon black to be blended is not particularly limited. Specific examples of the carbon black that may be used include: gas furnace black, oil furnace black, thermal black, lamp black, acetylene black, and Ketchen black.

Further, in a composition serving as a material for the surface layer, for example, a filler, a processing aid, a crosslinking aid, a crosslinking accelerator, a crosslinking accelerator aid, a crosslinking retardant, a softener, a plasticizer, or a dispersant, which is generally used as a compounding agent for a rubber, may be added as required. Examples of a mixing method for those raw materials may include: a mixing method involving using a closed mixer, such as a Banbury mixer or a pressure kneader; and a mixing method involving using an open mixer, such as an open roll.

The hollow particles have an average value for the sphere-equivalent diameters of their hollow portions of 7 μm or more and 100 μm or less, and an average shell thickness of 0.05 μm or more and 3.00 μm or less. The average value for sphere-equivalent diameters of the hollow portions is particularly preferably 25 μm or more and 60 μm or less, and the average shell thickness is preferably 1.30 μm or more and 2.50 μm or less. When such hollow particles are adopted, the generation of the discharge 22-5 resulting from the hollow particles is facilitated, and the polarity of the contamination adhering to the depression 10 can be reversed more easily. In addition, with the reversal of the polarity of the contamination, the contamination adhering to the concave portion is purged toward the photosensitive member, and thus the adhesion of toner to the protrusion can be suppressed.

In addition, the average depth of the depression 10 is 1.0 μm or more and 6.0 μm or less, preferably 2.0 μm or more and 6.0 μm or less. With this, pressure contact of the contamination, such as toner, adhering to the depression with the charging member can be suppressed. In addition, the contamination having its polarity reversed in the depression is easy to return to the photosensitive member.

It is preferred from the viewpoint of suppressing pressure contact of the contamination with the charging member that the protrusions derived from the hollow particles each have high hardness at the time of low compression and each have low hardness at the time of high compression. At the time of low compression, high hardness is preferred so as to prevent the contamination from being buried. In addition, at the time of high compression, low hardness is preferred so as to prevent the contamination from being crushed. Specifically, it is preferred that the Martens hardness of each of the protrusions at an indentation depth of 0.1 μm be 8.0 $N/mm^2$ or more and the Martens hardness of each of the protrusions at an indentation depth of 1.0 μm be 1.2 $N/mm^2$ or less.

The Martens hardness of the elastic layer is preferably 2.0 $N/mm^2$ or more at an indentation depth of 1.0 μm. When the Martens hardness of the elastic layer is 2.0 $N/mm^2$ or more, the reduction of the heights of the protrusions due to the burial of the hollow particles into the elastic layer can be suppressed.

<Manufacturing Method for Charging Member>

An example of a manufacturing method for the charging member according to this aspect is described.

(Step 1) A step of preparing an unvulcanized rubber composition containing a rubber material serving as a binder, and thermally expandable microcapsule particles (unvulcanized rubber-preparing step).

(Step 2) A step of subjecting the unvulcanized rubber composition to extrusion molding onto an electroconductive support, and then crosslinking the unvulcanized rubber composition to form the elastic layer.

Said (step 2) may particularly include the following steps.

(Step 2-1) A step of integrally subjecting an electroconductive support (mandrel) and the unvulcanized rubber composition to crosshead extrusion molding (extrusion molding step).

(Step 2-2) A step of vulcanizing a layer of the unvulcanized composition formed on the electroconductive support and a step of foaming (thermally expanding) the thermally expandable microcapsule particles (vulcanizing/foaming step).

(Step 1)

First, an unvulcanized rubber composition containing an electroconductive rubber and thermally expandable microcapsule particles is prepared as a material for forming the surface layer.

The thermally expandable microcapsule particles are preferably used as precursors of the hollow particles. This is because, when the thermally expandable microcapsule particles are used, the protrusions derived from the hollow particles exposed from the surface of the surface layer can be easily formed. Another reason is that, when the thermally expandable microcapsule particles are used, the balance between foaming and vulcanization can be adjusted by controlling a heating method, and hence the thicknesses of the shells of the hollow particles, the depths of the depressions, and the average diameter of hollow portions of each of the hollow particles can be controlled. Accordingly, a relationship between the crosslinking starting temperature (Tc) of the unvulcanized rubber composition and the foaming starting temperature (Ts) of the thermally expandable microcapsule particles is preferably such that the foaming starting temperature is higher than the crosslinking starting temperature. The reason for this is described later.

Crosslinking Starting Temperature (Tc)

The crosslinking starting temperature described herein may be determined using a Mooney viscometer (product name: SMT300RT, manufactured by Shimadzu Corporation) in accordance with Japanese Industrial Standards (JIS) K6300-1:2013 as described below. At each of temperatures of from 130° C. to 160° C. at an increment of 5° C., the scorch time of the rubber composition is determined. The scorch time is the time it takes for a Mooney viscosity (ML1+4) measured using an L-shaped rotor to increase from a minimum value Vm by 5 points. A relationship between the resultant scorch time and the measurement temperature is subjected to log approximation. The temperature at which the scorch time is 10 minutes is determined from the approximate curve, and this temperature is defined as the crosslinking starting temperature.

Foaming Starting Temperature (Ts)

The foaming starting temperature may be determined using a thermomechanical analyzer (TMA) (product name: TMA 2940, manufactured by TA Instruments) as described below. While the thermally expandable microcapsule particles are heated at a temperature increase rate of 5° C./min from 80° C. to 220° C., the displacement of a measuring terminal in a vertical direction is measured, and the temperature at which the displacement starts to increase (temperature at the time of a change from contraction to expansion) is defined as the foaming starting temperature. In this case, the measurement is performed in such a state that 25 μg of the sample (thermally expandable microcapsule particles) is placed in a container made of aluminum having a diameter of 7 mm and a depth of 1 mm and a force of 0.1 N is applied from above.

The rubber composition is preferably prepared so that the Mooney viscosity at a time when the unvulcanized rubber is subjected to the extrusion molding may be 50 M or more because the exposure of the hollow particles from the surface of the charging member is further promoted. This is presumably because, when the Mooney viscosity is 50 M or more, the fluidity of the rubber composition at the time of the extrusion molding is suppressed, and hence a phenomenon in which the thermally expandable microcapsule particles are localized in an inner portion where the flow rate is high is suppressed.

The content of the thermally expandable microcapsule particles in the unvulcanized rubber composition is preferably from 0.5 part by mass or more and 20 parts by mass or less with respect to 100 parts by mass of the raw material rubber. When the content falls within such range, a suitable amount of the hollow particles can be allowed to be present in the surface of the charging member.

A vulcanizing agent may be appropriately selected in consideration of the rubber material to be used.

(Step 2-1)

The unvulcanized rubber composition may be used and molded into a roller shape to be used as a charging member. Extrusion molding is preferred for exposing the thermally expandable microcapsule particles at the surface of the molded product. A manufacturing method based on die molding, or a manufacturing method involving grinding the product of the extrusion molding is also available as a manufacturing method for the charging member, but the extrusion molding is preferred from the viewpoint of the ease of the formation of the protrusions with the particles.

Figure 4:
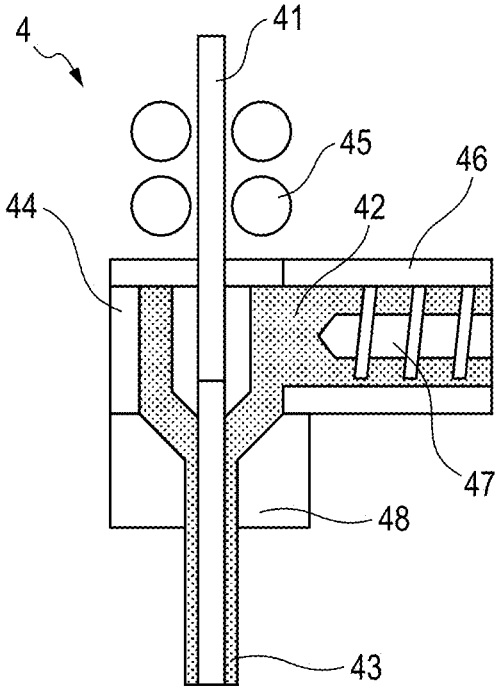
FIG. 4 is a schematic construction view of an example of a crosshead extrusion molding machine.

FIG. 4 is a schematic construction view of a crosshead extrusion molding machine 4. The crosshead extrusion molding machine 4 is an apparatus for uniformly covering a mandrel 41 over its entire periphery with an unvulcanized rubber composition 42, to manufacture an unvulcanized rubber roller 43 having the mandrel 41 inserted in its center.

The crosshead extrusion molding machine 4 includes: a crosshead 44 into which the mandrel 41 and the unvulcanized rubber composition 42 are to be fed; conveying rollers 45 configured to feed the mandrel 41 into the crosshead 44; and a cylinder 46 configured to feed the unvulcanized rubber composition 42 into the crosshead 44.

The conveying rollers 45 are configured to continuously feed a plurality of the mandrels 41 in an axis direction into the crosshead 44. The cylinder 46 includes a screw 47 in its inside, and is configured to feed the unvulcanized rubber composition 42 into the crosshead 44 by the rotation of the screw 47.

When the mandrel 41 is fed into the crosshead 44, its entire periphery is covered with the unvulcanized rubber composition 42 fed from the cylinder 46 into the crosshead. Then, the mandrel 41 is delivered out of a die 48 at the discharge port of the crosshead 44, as the unvulcanized rubber roller 43 having its surface covered with the unvulcanized rubber composition 42.

In that case, the extrusion molding is preferably performed at a temperature lower than the foaming starting temperature of the thermally expandable microcapsule particles in order to control the thicknesses of the shells, the depths of the depressions, and the particle diameters of the hollow particles, and effectively form exposed protrusions derived from the hollow particles at the surface of the charging member. An extrusion molding temperature is lower than a vulcanization temperature.

The unvulcanized rubber composition may be molded into a so-called crown shape in which the central portion of each of the mandrels 41 in its longitudinal direction has an outer diameter (thickness) larger than that of an end portion thereof. Specifically, the crown shape is formed by gradually changing the rate at which the mandrel is fed so that the rate may be high at the end portion and low at the central portion while keeping the extrusion discharge amount of the unvulcanized rubber composition constant. Thus, the unvulcanized rubber roller 43 is obtained.

(Step 2-2)

Then, the unvulcanized rubber roller is heated to provide a vulcanized rubber roller. As specific examples of a method for heating treatment, there may be given: blast furnace heating with a gear oven; heating with a far infrared ray; steam heating with a vulcanizer; and the like. Of those, blast furnace heating and far infrared ray heating are suitable for continuous production, and hence are preferred.

Two-stage heating treatment is preferably performed in this step. This is because the average shell thickness of the hollow particles, the average depth of the depressions, and the average diameter of hollow portions of each of the hollow particles can be controlled based on the temperature conditions of the two-stage heating. That is, the shells of the hollow particles are softened by heat generated when the layer of the unvulcanized rubber composition is vulcanized. Then, an encapsulated substance included in the hollow portion of each of the hollow particles vaporizes. At this time, the shells of the hollow particles have been softened, and hence the hollow particles thermally expand to form the protrusions. After that, the encapsulated substance in the hollow portion leaks into the atmosphere through the portion of each of the hollow particles exposed from the elastic layer, and the shell at the portion of each of the hollow particles exposed from the elastic layer contracts to form a concave portion.

Here, the crosslinking starting temperature Tc (° C.) of the unvulcanized rubber composition is preferably set within the range of from (Ts (° C.)−10° C.) or more to (Ts (° C.)+15° C.) or less with respect to the foaming starting temperature Ts of the thermally expandable microcapsule particles.

That is, when the Tc (° C.) and the Ts (° C.) are set to have a relationship represented by the following expression (1), it is easy to achieve a state in which the shells are thin by simultaneously causing the crosslinking and the foaming and greatly foaming the thermally expandable microcapsule particles in primary heating (primary vulcanization). When secondary heating (secondary vulcanization) is subsequently performed at a higher temperature, by virtue of the softening of the shells, large protrusions can be formed, and suitable depressions can also be formed.

$$(Ts-10^\circ\ \text{C.}) \leq Tc \leq (Ts+15^\circ\ \text{C.}) \qquad \text{Expression (1)}$$

If Tc≥(Ts−10° C.), when the primary heating is performed at the crosslinking starting temperature, preferential occurrence of the crosslinking over the foaming can be easily suppressed, and hence the following phenomenon is easily suppressed. That is, the phenomenon is as follows: the foaming of the thermally expandable microcapsule particles is suppressed by the surrounding binder, the thicknesses of the shells become comparatively large, and the depths of the depressions formed as a result of the softening of the shells in the secondary heating to be subsequently performed become comparatively shallow.

The foaming starting temperature may be controlled through the selection of the kind of the encapsulated substance of each of the thermally expandable microcapsule particles.

If Tc≤(Ts+15° C.), when the primary heating is performed at the crosslinking starting temperature, preferential occurrence of the foaming over the crosslinking can be easily suppressed, and hence the following phenomenon is easily suppressed. That is, when the thermally expandable microcapsule particles foam, a comparatively large amount of the encapsulated substance diffuses to the outside of the shells, and in addition, the gas permeability of the binder in an uncrosslinked state is high, and hence the thermally expandable microcapsule particles uniformly contract while maintaining spherical shapes. As a result, the hollow particles become small, and hence the thicknesses of the shells become comparatively large. When the secondary heating is subsequently performed, the encapsulated substance remains in the shells only in a comparatively small amount and the thicknesses of the shells are comparatively large, and hence the depths of the depressions become comparatively shallow. The phenomenon is as described above.

In the secondary heating, heating is performed to a high temperature of preferably the foaming starting temperature plus from 30° C. to 60° C. to cause the vaporization of the encapsulated substance of each of the particles and the softening of their shells, to thereby release the encapsulated substance to the outside of the shells. Thus, the hollow particles contract to form the depressions. When the secondary heating temperature is (Ts+30° C.) or more, the diffusion of the encapsulated substance to the outside of the shells and the softening of the shells can be promoted, and it is easy to form suitable depressions. When the secondary heating temperature is (Ts+60° C.) or less, it is easy to cause the diffusion of the encapsulated substance to the outside of the shells and the softening of the shells to fall within suitable ranges, and hence it is easy to form protrusions having suitable depressions.

As the secondary heating temperature becomes higher, the internal pressure of each of the hollow particles increases. As a result, the leakage amount of the encapsulated substance in each of the hollow portions can be increased, and the depths of the depressions can be increased. Both end portions of the rubber composition after the vulcanization/foaming are removed in a subsequent separate step, and thus a vulcanized/foamed rubber roller is obtained. Therefore, in the resultant vulcanized/foamed rubber roller, both end portions of the mandrel are exposed.

The temperature of the primary heating may be selected, for example, in the range of from the crosslinking starting temperature Tc or more to less than the secondary heating temperature.

In the present disclosure, in order to simplify a production process, it is most preferred that the electroconductive elastic layer be a single layer, that is, the electroconductive elastic layer serving as the surface layer be the only electroconductive elastic layer.

In addition, the thickness of the surface layer in this case falls within the range of preferably from 0.8 mm or more to 4.0 mm or less, particularly preferably from 1.2 mm or more to 3.0 mm or less, in order to ensure a nip width with the photosensitive member.

As another manufacturing method, the following example is given: a method involving preparing an unvulcanized rubber composition containing a rubber composition and hollow particles, subjecting the unvulcanized rubber composition to extrusion molding and vulcanization, and then pressing the resultant against a hot plate to depress the apex of each of the hollow particles.

(Elastic Layer)

The outer surface of the elastic layer constituting a part of the outer surface of the charging member preferably has a low adhesion property.

An external additive of toner may adhere to the outer surface of the elastic layer. The adhesion of the external additive to a charging roller becomes more remarkable as the number of image-output sheets increases. Meanwhile, when a phenomenon in which toner on the photosensitive member passes through a cleaning blade occurs, the external additive on the surface of the charging roller is removed by the toner that has passed. When the amount of the external additive adhering to the surface of the charging roller is large, a large difference occurs in adhesion amount of the external additive in the outer surface of the charging roller between a portion through which the toner has passed and a portion through which the toner has not passed. Accordingly, unevenness is generated in charging amount of the photosensitive member, with the result that a vertical streak-like image failure occurs in some cases. Therefore, it is preferred that fine particles, such as the external additive, hardly adhere to the outer surface of the elastic layer.

In order that the outer surface of the elastic layer may have a low adhesion property, the secondary heating temperature in the formation process of the elastic layer is preferably set to be high, and is, for example, preferably 170° C. or more. When the secondary heating temperature is set to be high, crosslinking density is increased, allowing the outer surface of the elastic layer to have a low adhesion property.

In particular, it is most preferred to use an acrylonitrile rubber as the raw material rubber because the low adhesion property-imparting effect of the heating treatment is satisfactorily obtained. The nitrile content of the acrylonitrile rubber is preferably from 15 mass % to 42 mass %.

In addition, the surface of the roller may be subjected to various surface treatments. Of those, UV light treatment is most preferred from the viewpoint of reducing the adhesion of contamination.

(Thermally Expandable Microcapsule Particles)

The thermally expandable microcapsule particles are each a material that contains an encapsulated substance in its shell, and becomes a hollow particle through expansion of the encapsulated substance when heat is applied thereto.

Examples of the thermally expandable microcapsule particles serving as a raw material for the hollow particles include particles each having a shell containing a thermoplastic resin.

Examples of the thermoplastic resin include:

an acrylonitrile resin, a vinyl chloride resin, a vinylidene chloride resin, a methacrylic acid resin, a styrene resin, a urethane resin, an amide resin, a methacrylonitrile resin, an acrylic acid resin, an acrylic acid ester resin, and a methacrylic acid ester resin.

Those thermoplastic resins may be used alone or in combination thereof. Further, monomers serving as raw materials for those thermoplastic resins may be copolymerized to be used as a copolymer. Of those, a thermoplastic resin formed of at least one kind selected from an acrylonitrile resin, a vinylidene chloride resin, and a methacrylonitrile resin, each of which has low gas permeability and shows high impact resilience, is preferably used.

The encapsulated substance of each of the thermally expandable microcapsule particles is preferably one that becomes a gas to expand at a temperature equal to or lower than the softening point of the thermoplastic resin, and examples thereof include:

low-boiling-point liquids, such as propane, propylene, butene, n-butane, isobutane, n-pentane, isopentane, and isopentene; and high-boiling-point liquids, such as n-hexane, isohexane, n-heptane, n-octane, isooctane, n-decane, and isodecane.

The above-mentioned thermally expandable microcapsule particles may be produced by a known production method, such as a suspension polymerization method, an interfacial polymerization method, an interfacial settling method, or a solvent evaporation method. For example, the suspension polymerization method may be exemplified by a method involving mixing a polymerizable monomer, the substance to be encapsulated in each of the thermally expandable microcapsule particles, and a polymerization initiator, and dispersing the mixture in an aqueous medium containing a surfactant or a dispersion stabilizer, followed by suspension polymerization. A compound having a reactive group capable of reacting with a functional group of the polymerizable monomer, or an organic filler may also be added.

Examples of the polymerizable monomer may include: acrylonitrile, methacrylonitrile, α-chloroacrylonitrile, α-ethoxyacrylonitrile, fumaronitrile, acrylic acid, methacrylic acid, itaconic acid, maleic acid, fumaric acid, citraconic acid, vinylidene chloride, and vinyl acetate; acrylic acid esters (methyl acrylate, ethyl acrylate, n-butyl acrylate, isobutyl acrylate, t-butyl acrylate, isobornyl acrylate, cyclohexyl acrylate, and benzyl acrylate); methacrylic acid esters (methyl methacrylate, ethyl methacrylate, n-butyl methacrylate, isobutyl methacrylate, t-butyl methacrylate, isobornyl methacrylate, cyclohexyl methacrylate, and benzyl methacrylate); and styrene-based monomers, acrylamide, substituted acrylamides, methacrylamide, substituted methacrylamides, butadiene, ε-caprolactam, polyether, and isocyanates. Those polymerizable monomers may be used alone or in combination thereof.

As the polymerization initiator, an initiator soluble in the polymerizable monomer is preferred, and a known peroxide initiator and azo initiator may be used. Of those, an azo initiator is preferred. Examples of the azo initiator include: 2,2'-azobisisobutyronitrile, 1,1'-azobiscyclohexane-1-carbonitrile, and 2,2'-azobis-4-methoxy-2,4-dimethylvaleronitrile. Of those, 2,2'-azobisisobutyronitrile is preferred. As the peroxide initiator, for example, dicumyl peroxide may be used. When the polymerization initiator is used, its amount is preferably from 0.01 part by mass to 5 parts by mass with respect to 100 parts by mass of the polymerizable monomer.

As the surfactant, an anionic surfactant, a cationic surfactant, a nonionic surfactant, an amphoteric surfactant, or a polymeric dispersant may be used. The use amount of the surfactant is preferably from 0.01 part by mass to 10 parts by mass with respect to 100 parts by mass of the polymerizable monomer.

Examples of the dispersion stabilizer include: organic fine particles (e.g., polystyrene fine particles, polymethyl methacrylate fine particles, polyacrylic acid fine particles, and polyepoxide fine particles), silica (e.g., colloidal silica), calcium carbonate, calcium phosphate, aluminum hydroxide, barium carbonate, and magnesium hydroxide. The use amount of the dispersion stabilizer is preferably from 0.01 part by mass to 20 parts by mass with respect to 100 parts by mass of the polymerizable monomer.

The suspension polymerization is preferably performed under a sealed state using a pressure container. In addition, the raw materials for polymerization may be suspended with a dispersing machine or the like and then transferred into the pressure container to be subjected to suspension polymerization, or may be suspended in the pressure container. A polymerization temperature is preferably from 50° C. to 120° C. The polymerization may be performed under the atmospheric pressure, but is preferably performed under increased pressure (e.g., under a pressure of the atmospheric pressure plus from 0.1 MPa to 1 MPa) in order to prevent the vaporization of the substance to be encapsulated in each of the thermally expandable microcapsule particles. After the completion of the polymerization, solid-liquid separation and washing may be performed by centrifugation and filtration. When the solid-liquid separation and the washing are performed, the resultant may be then subjected to drying and pulverization (of aggregated particles into primary particles) at a temperature lower than the softening temperature of the resin forming the thermally expandable microcapsule particles. The drying and the pulverization may be performed by a known method, and an air-flow dryer, a hot air circulation dryer, and a Nauta mixer may be used. In addition, the drying and the pulverization may be simultaneously performed with a pulverizing dryer. The surfactant and the dispersion stabilizer may be removed by repeating washing and filtration after the production.

The shape of each of the hollow particles is not particularly limited, and examples thereof include a spherical shape, an amorphous shape, and an elliptical shape.

(Measurement of Electrically Insulating Properties of Hollow Particles)

The hollow particles preferably have a volume resistivity of $10^{10}$ Ωcm or more from the viewpoint of efficiently causing discharge with respect to the contamination adhering to the concave portions. The volume resistivity of the hollow particles may be determined as the volume resistivity of a pellet as follows: the hollow particles are pressurized to be pelletized and the volume resistivity of the pellet is measured with a powder resistivity measurement apparatus.

As a powder resistivity measurement apparatus, a powder resistivity measurement system (product name: MCP-PD51 model, manufactured by Mitsubishi Chemical Analytech Co., Ltd.) may be used. For the pelletization, the hollow particles to be subjected to the measurement are placed in a cylindrical chamber, which has a diameter of 20 mm, of the powder resistivity measurement apparatus. Their loading amount is set so that the thickness of the pellet pressurized at 20 kN may be from 3 mm to 5 mm. The measurement is performed under a 23° C./50% RH environment at an applied voltage of 90 V and a load of 4 kN.

According to some aspects of the present disclosure, the charging member capable of still more stably exhibiting charging performance even when used for a long period of time because contamination is still less liable to accumulate on the protrusions of the roller surface and the manufacturing method therefor are provided. According to other aspects of the present disclosure, the process cartridge and the electrophotographic image forming apparatus capable of forming high-quality electrophotographic images for a long period of time are provided.

Now, the present disclosure is further described specifically by way of Examples and Comparative Examples. The present disclosure is not limited thereto.

Production Examples 1 to 4 are production methods for thermally expandable microcapsule particles 1 to 4 serving as materials for forming hollow particles. In addition, for unspecified reagents and the like, commercially available high-purity products were used unless otherwise stated. In each example, a charging roller was produced as a charging member.

Production Example 1

An aqueous mixed liquid containing the following components was prepared.

Ion-exchanged water: 4,000 parts by mass

Dispersion stabilizer: 9 parts by mass of colloidal silica and 0.15 part by mass of polyvinylpyrrolidone Next, an oily mixed liquid containing the following components was prepared.

Polymerizable monomer: 50 parts by mass of acrylonitrile, 45 parts by mass of methacrylonitrile, and 5 parts by mass of methyl methacrylate.

Encapsulated substance: 4.2 parts by mass of isopentene and 7.5 parts by mass of n-hexane.

Polymerization initiator: 0.75 part by mass of dicumyl peroxide.

The oily mixed liquid was added to the aqueous mixed liquid, and 0.4 part by mass of sodium hydroxide was further added thereto to prepare a dispersion liquid.

The resultant dispersion liquid was mixed by stirring for 3 minutes using a homogenizer, charged into a polymerization reaction vessel that had been purged with nitrogen, and subjected to a reaction under stirring at 400 rpm with a homogenizer at a pressure of 0.5 MPa and 60° C. for 20 hours to prepare a reaction product. The resultant reaction product was repeatedly filtered and washed with water, and then dried at 80° C. for 5 hours to produce thermally expandable microcapsule particles.

The resultant thermally expandable microcapsule particles were sieved with a dry air-flow classifier (product name: Classiel N-20, manufactured by Seishin Enterprise Co., Ltd.) to provide thermally expandable microcapsule particles 1. As a classification condition, the number of rotations of a classification rotor was set to 1,600 rpm.

A "volume average particle diameter" determined by the following method was adopted as the average particle diameter of the thermally expandable microcapsule particles. Measurement is performed using a laser diffraction particle size analyzer (product name: Coulter LS-230 Particle Size Analyzer, manufactured by Coulter). An aqueous module is used for the measurement, and pure water is used as a measurement solvent. The inside of the measurement system of the particle size analyzer is washed with pure water for about 5 minutes, 10 mg to 25 mg of sodium sulfite is added as an antifoaming agent into the measurement system, and the "background function" is executed. Next, three or four droplets of an anionic surfactant are added into 50 ml of pure water, and 1 mg to 25 mg of a measurement sample is further added. The aqueous solution having suspended therein the sample is subjected to dispersion treatment with an ultrasonic disperser for from 1 minute to 3 minutes to prepare a test sample solution. The test sample solution is gradually added into the measurement system of the above-mentioned measurement apparatus to adjust the test sample concentration in the measurement system so that "PIDS" on the screen of the apparatus may be 45% or more and 55% or less before the measurement. The volume average particle diameter is calculated from the resultant volume distribution.

Further, the volume resistivity of the resultant hollow particles was measured as described above.

The resultant thermally expandable microcapsule particles 1 had a volume average particle diameter of 7.0 μm and a volume resistivity value of $3.8\times10^{10}$ Ωcm.

Production Example 2

Thermally expandable microcapsule particles 2 were obtained by the same method as in Production Example 1 except that: the amount of the colloidal silica was changed to 4 parts by mass; the number of rotations of the homogenizer at the time of polymerization was changed to 100 rpm; and the number of rotations of the classification rotor was changed to 1,350 rpm. The resultant thermally expandable microcapsule particles 2 had a volume average particle diameter of 25.5 μm and a volume resistivity value of $4.1\times10^{10}$ Ωcm.

Production Example 3

Thermally expandable microcapsule particles 3 were obtained by the same method as in Production Example 1 except that: the amount of the colloidal silica was changed to 14 parts by mass; the number of rotations of the homogenizer at the time of polymerization was changed to 1,200 rpm; and the number of rotations of the classification rotor was changed to 1,800 rpm. The resultant thermally expandable microcapsule particles 3 had a volume average particle diameter of 3.5 μm and a volume resistivity value of $3.7\times10^{10}$ Ωcm.

Production Example 4

Thermally expandable microcapsule particles 4 were obtained by the same method as in Production Example 1 except that: the amount of the colloidal silica was changed to 1 part by mass; the number of rotations of the homogenizer at the time of polymerization was changed to 200 rpm; and the number of rotations of the classification rotor was changed to 1,500 rpm. The resultant thermally expandable microcapsule particles 4 had a volume average particle diameter of 50.0 μm and a volume resistivity value of $4.0\times10^{10}$ Ωcm.

Example 1

(Preparation of Unvulcanized Rubber Composition for Elastic Layer)

Materials shown in Table 1 were mixed using a 6 L pressure kneader (product name: TD6-15MDX, manufactured by Toshin Co., Ltd.) at a loading ratio of 70 vol % and a number of rotations of a blade of 30 rpm for 16 minutes to provide an A-kneaded rubber composition.

TABLE 1

| | |
|---|---|
| Acrylonitrile-butadiene rubber (product name: N230SV, manufactured by JSR Corporation) | 100 parts by mass |
| Zinc stearate | 1 part by mass |
| Zinc oxide | 5 parts by mass |
| Calcium carbonate (product name: Super #1700, manufactured by Maruo Calcium Co., Ltd.) | 15 parts by mass |
| Carbon black (product name: TOKABLACK #7360SB, manufactured by Tokai Carbon Co., Ltd.) | 50 parts by mass |

Then, materials shown in Table 2 below were subjected to bilateral cutting a total of 20 times with an open roll having a roll diameter of 12 inches (0.30 m) at a number of rotations of a front roll of 10 rpm, a number of rotations of a back roll of 8 rpm, and a roll gap of 2 mm. After that, tight milling was performed 10 times at a roll gap of 0.5 mm to provide an unvulcanized rubber composition for a surface layer.

TABLE 2

| | |
|---|---|
| A-kneaded rubber composition | 171 parts by mass |
| Sulfur | 1.2 parts by mass |
| Tetrabenzylthiuram disulfide (product name: NOCCELER TBzTD, manufactured by Ouchi Shinko Chemical Industrial Co., Ltd.) | 1.2 parts by mass |
| N-t-Butyl-2-benzothiazole sulfenimide (product name: SANTOCURE-TBSI, manufactured by FLEXSYS) | 1.2 parts by mass |
| Thermally expandable microcapsule particles (Production Example 3) | 6 parts by mass |

(Molding of Vulcanized Rubber Layer)

A mandrel was covered with the unvulcanized rubber composition for a surface layer through the use of a crosshead extrusion molding machine having a cylinder diameter of 70 mm and a ratio of L/D=20 to provide an unvulcanized rubber roller having a crown shape. In this case, molding was performed at an extrusion molding temperature of 100° C. and a number of rotations of a screw of 9 rpm while the feed rate of the mandrel was changed. The length of the mandrel was 252.5 mm, the diameter of the mandrel was 6 mm, the die inner diameter of the crosshead extrusion molding machine was 8.0 mm, the outer diameter of the unvulcanized rubber roller at the center in its axis direction was 8.25 mm, and the outer diameter of an end portion thereof was 8.05 mm.

After that, the unvulcanized layer of the unvulcanized rubber roller was heated in an electric hot air furnace at a temperature of 155° C. for 30 minutes, and then at 185° C. for 30 minutes to vulcanize the unvulcanized rubber layer, and both end portions of the vulcanized rubber layer were cut to adjust the length of the vulcanized rubber layer in its axis direction to 232 mm. Thus, a vulcanized rubber roller was obtained.

(Measurement of Mooney viscosity)

The unvulcanized rubber composition was preheated for 1 minute under the same heating condition of 100° C. as the extrusion molding temperature and measured for its Mooney viscosity (ML1+4) value 4 minutes thereafter using a Mooney viscometer (product name: SMT300RT, manufactured by Shimadzu Corporation) in accordance with JIS-K6300-1:2013.

As a result, the Mooney viscosity was found to be 59.9 M.

(Foaming Starting Temperature of Thermally Expandable Microcapsule Particles)

A foaming starting temperature was measured by the above-mentioned method. As a result, the foaming starting temperature was found to be 140° C.

(Crosslinking Starting Temperature)

A crosslinking starting temperature was measured by the above-mentioned method. As a result, the crosslinking starting temperature was found to be 155° C.

(Observation of Particles)

The hollow particles exposed at the surface of the charging member were observed with a confocal microscope (product name: OPTELICS HYBRID, manufactured by Lasertec Corporation). Observation conditions were set to an objective lens magnification of 50, a number of pixels of 1,024 pixels, and a height resolution of 0.1 μm. The particles were present in an exposed state.

(Measurement of Martens Hardness of Protrusions derived from Hollow Particles)

The Martens hardness of the surface of the hollow particles exposed at the surface of the charging member (Martens hardness of protrusions) was measured using a microhardness meter (product name: PICODENTOR HM500, manufactured by Fischer Instruments K.K.) and a microscope included with the meter.

Specifically, the Martens hardness was measured under a driving speed condition represented by the following equation (1) by bringing a square pyramid-shaped diamond indenter into contact with a core portion identified with a confocal microscope in the observation of the hollow particles under a 25° C./50% RH environment using the microscope included with the microhardness meter. An edge forming the depression of each of the hollow particles to be observed in a microscopic observation image has a circular shape or an elliptical shape. Therefore, a portion where its long diameter and short diameter cross each other was defined as the core portion.

$$dF/dt=1\ \text{mN}/50\ \text{seconds} \qquad \text{Equation (1)}$$

In the equation (1), F represents force, and t represents time.

Respective hardnesses at indentation depths of the indenter of 0.1 μm and 1.0 μm were extracted from the measurement results. For each of a case in which the indentation depth was 0.1 μm and a case in which the indentation depth was 1.0 μm, values at 10 points measured and extracted by a similar technique were averaged to provide an average value for the Martens hardnesses of the protrusions.

The average Martens hardness was 8.6 $N/mm^2$ at an indentation depth of 0.1 μm, and was 1.2 $N/mm^2$ at an indentation depth of 1.0 μm.

(Measurement of Martens Hardness of Binder Portion)

The hardness of a binder portion identified with a confocal microscope was measured in the same manner as in the measurement of the Martens hardness of the protrusions derived from the hollow particles. The binder portion is a portion of the rubber layer at which exposure of the protrusions derived from the hollow particles is not found. A Martens hardness at an indentation depth of the indenter of 1.0 μm was calculated from measurement results, and measured and extracted values at 10 points were averaged to provide an average value for the Martens hardness of the binder portion.

The average Martens hardness at an indentation depth of 1.0 μm was 2.2 $N/mm^2$.

(Measurement of Average Height of Protrusions Derived from Hollow Particles and Average Depth of Depressions)

For the average depth of the depressions, a depression depth image in the protrusions of the surface of the charging member was measured with a confocal microscope (product name: OPTELICS HYBRID, manufactured by Lasertec Corporation). The depression depth image is the distance between the edge portion of the depression constituting the apex in each protrusion and the lowest point of the depression, i.e., a portion of the depression nearest to the outer surface of the substrate. Accordingly, first, the height of the apex in each protrusion, i.e., the distance between the outer surface of the substrate and a site in the edge portion of the depression farthest away from the outer surface of the substrate was measured.

Observation conditions were set to an objective lens magnification of 50, a number of pixels of 1,024 pixels, and a height resolution of 0.1 μm, and a value obtained by subjecting the acquired image to plane correction with a quadric surface was defined as the value of the height.

A cross-sectional profile of the protrusions of the hollow particles was extracted from the topographic image, and the distance between the average line of height and the apex in each protrusion was determined. The apex in each protrusion was the highest portion in the edge portion of the depression present in the protrusion. Such values at 100 points (100 protrusions) were averaged, and the average value was defined as the average height of the protrusions.

As a result of observation with a confocal microscope, it was confirmed that a depression was present at the apex portion in each of all the 100 points of the protrusions derived from the hollow particles exposed at the surface.

For each protrusion, the distance between the apex of the protrusion and the lowest point of the depression in the protrusion was determined. Such values at 100 points (100 depressions) were averaged, and the average value was defined as the average depth of the depressions. Observation conditions were set to an objective lens magnification of 50, a number of pixels of 1,024 pixels, and a height resolution of 0.1 μm, and a value obtained by subjecting the acquired image to plane correction with a quadric surface was used.

The average depth of the depressions was 2.2 μm.

(Measurement of Average Diameter of Hollow Portion and Average Thickness of Hollow Particles)

A focused ion beam-scanning electron microscope (product name: Zeiss NVision 40 FIB, manufactured by Carl-Zeiss) was used to measure the average diameter of hollow portion and average thickness of the hollow particles. While the charging member was sliced off with a focused ion beam, images were acquired to provide a 3D image of the hollow particles.

First, while a random protrusion including its periphery was sliced for every 0.1 μm of thickness with a focused ion beam, cross-sectional images thereof were taken. Images acquired based on the cross-sectional images were reconstructed into a three-dimensional image. Thus, a three-dimensional image for showing the shape of a hollow particle was obtained.

From the volume of the hollow portion of the three-dimensional image, the diameter of a sphere having the same volume as the above-mentioned volume (volume sphere-equivalent diameter) was calculated. Such values at 100 points (100 hollow portions) were averaged, and the average value was defined as the average diameter of hollow portion.

In addition, the shell thickness of the hollow particle in the three-dimensional image was measured at a random site for one hollow particle. Values at 100 points (100 hollow portions) were averaged, and the average value was defined as the average shell thickness of the hollow particles. The average diameter of hollow portion was 28 μm, and the average shell thickness was 1.35 μm.

(Evaluation of Horizontal Streak Image after Endurance)

The charging member was incorporated as a charging roller into an electrophotographic process cartridge for an electrophotographic image forming apparatus for A4 paper lengthwise output (product name: LBP7200C, manufactured by Canon Inc.), and the process cartridge was incorporated into the electrophotographic image forming apparatus, followed by image evaluation. Image output was performed under a 23° C./50% RH environment. An evaluation image is a halftone image (image in which lines each having a width of 1 dot were drawn at an interval of 2 dots in a direction perpendicular to the rotation direction of an electrophotographic photosensitive member) on A4 paper. The output image was evaluated as follows: a halftone image at the time of the output of 1 sheet (initial stage), and halftone images output after the printing of 10,000 sheets, 20,000 sheets, and 30,000 sheets at a print density of 1% (after endurance) were each visually observed for uniformity, and the presence or absence of horizontal streak-like image unevenness due to toner contamination on the surface of the charging member was evaluated based on the following criteria. This evaluation is for evaluating the degree of a change in state of discharge from the protrusions due to the adhesion of toner to the surface protrusions derived from the hollow particles.

Rank A: No horizontal streak-like image unevenness was generated.

Rank B: Horizontal streak-like image unevenness was very slightly generated.

Rank C: Horizontal streak-like image unevenness was slightly generated.

Rank D: Horizontal streak-like image unevenness was generated.

Rank E: Horizontal streak-like image unevenness was remarkably generated.

(Evaluation of Vertical Streak Image after Endurance)

Evaluation was performed by visually observing the vertical streak of a halftone image output after endurance of 10,000 sheets, 20,000 sheets, or 30,000 sheets by a similar evaluation method to that for the horizontal streak image evaluation. From the resultant images after endurance, vertical streak-like image unevenness generated by contamination of the outer surface of the elastic layer included in the outer surface of the charging member was evaluated based on the following criteria. This evaluation is for evaluating the presence or absence and degree of a vertical streak image generated owing to the presence of a portion in which an external additive adhering to the outer surface of the elastic layer has been removed by toner that has passed through a cleaning member and a portion in which the external additive has not been removed.

Rank A: No vertical streak-like image unevenness was generated.
Rank B: Vertical streak-like image unevenness was very slightly generated.
Rank C: Vertical streak-like image unevenness was slightly generated.
Rank D: Vertical streak-like image unevenness was recognized.
Rank E: Vertical streak-like image unevenness was remarkably recognized.

Examples 2 to 16

At least one of the material formulation or the production conditions was changed as shown in Table 3 and Table 4. Charging members of Examples 2 to 16 were produced in the same manner as in Example 1 except for the change(s). In Example 16, the surface of the charging member (surface of the surface layer) was subjected to curing treatment by being irradiated with UV light. In this case, the irradiation was performed with UV light having a wavelength of 254 nm so that the integrated light quantity was 9,000 mJ/cm$^2$. A low-pressure mercury lamp [manufactured by Toshiba Lighting & Technology Corporation] was used for the irradiation with UV light. The charging members according to Examples 2 to 16 were evaluated in the same manner as in Example 1. The evaluation results of the charging members according to Examples 1 to 16 are shown in Table 7 and Table 8.

TABLE 3

| | | Example | | | | | | | | | | | | | | | |
|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 |
| Elastic layer | NBR (N230SV) Acrylonitrile 35% | 100 | 100 | 100 | 100 | | | 100 | 100 | | | | 100 | | 100 | 70 | 100 |
| | NBR (N240S) Acrylonitrile 26% | | | | | | 100 | | | 100 | 100 | | | | | | |
| | NBR (N220S) Acrylonitrile 41% | | | | | | | | | | | 100 | | | | | |
| | NBR (N260S) Acrylonitrile 15% | | | | | 100 | | | | | | | | 100 | | | |
| | SBR (T2003) | | | | | | | | | | | | | | | 30 | |
| | Carbon black | 50 | 50 | 50 | 50 | 50 | 50 | 50 | 50 | 50 | 50 | 50 | 50 | 50 | 50 | 20 | 50 |
| | Zinc oxide | 5 | 5 | 5 | 5 | 5 | 5 | 5 | 5 | 5 | 5 | 5 | 5 | 5 | 5 | 5 | 5 |
| | Zinc stearate | 1 | 1 | 1 | 1 | 1 | 1 | 1 | 1 | 1 | 1 | 1 | 1 | 1 | 1 | 1 | 1 |
| | Calcium carbonate | 15 | 15 | 15 | 15 | 15 | 15 | 15 | 15 | 15 | 15 | 15 | 15 | 15 | 15 | 15 | 15 |
| | Sulfur | 1.2 | 1.2 | 1.5 | 0.9 | 1.5 | 1.5 | 1.8 | 2 | 1.5 | 1.5 | 1.5 | 1.2 | 2 | 1.5 | 1.5 | 1.2 |
| | NOCCELER TBzTD | 1.2 | 1.2 | 4.5 | 3.5 | 4.5 | 4.5 | 1.5 | 1.2 | 4.5 | 1.4 | 4.5 | 1.2 | 1 | 1.4 | 4.5 | 1.2 |
| | SANTOCURE-TBSI | 1.2 | 1.2 | | | | | 1 | 1.2 | | 1 | | 1.2 | 1 | 1 | | 1.2 |
| Thermally expandable microcapsule particles | 1 Average particle diameter: 7.0 μm | | | | ○ | ○ | | | | | ○ | | | | | | |
| | 2 Average particle diameter: 25.5 μm | | | | | | | | ○ | | | | | | | | |
| | 3 Average particle diameter: 3.5 μm | ○ | ○ | ○ | | | ○ | ○ | | ○ | | ○ | ○ | ○ | | ○ | ○ |
| | 4 Average particle diameter: 50.0 μm | | | | | | | | | | | | | | ○ | | |

TABLE 4

| | | Primary vulcanization | | Secondary vulcanization | | | Mooney viscosity of | Crosslinking starting | Foaming starting |
|---|---|---|---|---|---|---|---|---|---|
| | | Temperature ° C. | Time minutes | Temperature ° C. | Time minutes | UV light irradiation | unvulcanized rubber (100° C.) | temperature (° C.) | temperature (° C.) |
| Example | 1 | 155 | 30 | 185 | 30 | Absent | 59.9 | 155 | 140 |
| | 2 | 155 | 30 | 170 | 30 | Absent | 59.9 | 155 | 140 |
| | 3 | 140 | 30 | 180 | 30 | Absent | 60.2 | 130 | 140 |
| | 4 | 140 | 30 | 180 | 30 | Absent | 60.7 | 135 | 140 |
| | 5 | 150 | 30 | 170 | 30 | Absent | 61.9 | 130 | 140 |
| | 6 | 130 | 30 | 175 | 30 | Absent | 62.4 | 130 | 140 |
| | 7 | 150 | 30 | 170 | 30 | Absent | 58.7 | 150 | 140 |
| | 8 | 155 | 30 | 185 | 30 | Absent | 60.9 | 150 | 140 |
| | 9 | 130 | 30 | 170 | 30 | Absent | 62.4 | 130 | 140 |
| | 10 | 145 | 30 | 185 | 30 | Absent | 62.6 | 145 | 140 |
| | 11 | 130 | 30 | 180 | 30 | Absent | 64.8 | 130 | 140 |
| | 12 | 160 | 30 | 180 | 30 | Absent | 59.9 | 155 | 140 |
| | 13 | 170 | 30 | 185 | 30 | Absent | 61.5 | 150 | 140 |
| | 14 | 145 | 30 | 185 | 30 | Absent | 59.3 | 145 | 140 |
| | 15 | 130 | 30 | 180 | 30 | Absent | 48.9 | 130 | 140 |
| | 16 | 155 | 30 | 185 | 30 | Present | 59.9 | 155 | 140 |

Comparative Examples 1 to 9

At least one of the material formulation or the production conditions was changed as shown in Table 5 and Table 6. Charging members of Comparative Examples 1 to 9 were produced in the same manner as in Example 1 except for the change(s). In Comparative Example 8, the thermally expandable microcapsule particles were replaced with solid particles (product name: GANZPEARL GM2001, manufactured by Aica Kogyo Company, Limited). The charging members according to Comparative Examples 1 to 9 were evaluated in the same manner as in Example 1. The evaluation results of the charging members according to Comparative Examples 1 to 9 are shown in Table 9 and Table 10.

TABLE 5

| | | | Comparative Example | | | | | | | | |
|---|---|---|---|---|---|---|---|---|---|---|---|
| | | | 1 | 2 | 3 | 4 | 5 | 6 | 7 | 8 | 9 |
| Elastic layer | | NBR (N230SV) Acrylonitrile 35% | | 100 | 100 | | | | 100 | | |
| | | NBR (N240S) Acrylonitrile 26% | | | | | | | | | |
| | | NBR (N220S) Acrylonitrile 41% | | | | | | | | | |
| | | NBR (N260S) Acrylonitrile 15% | 100 | | | 100 | 100 | 100 | | 100 | 100 |
| | | SBR (T2003) | | | | | | | | | |
| | | Carbon black | 50 | 50 | 50 | 50 | 50 | 50 | 50 | 50 | 50 |
| | | Zinc oxide | 5 | 5 | 5 | 5 | 5 | 5 | 5 | 5 | 5 |
| | | Zinc stearate | 1 | 1 | 1 | 1 | 1 | 1 | 1 | 1 | 1 |
| | | Calcium carbonate | 15 | 15 | 15 | 15 | 15 | 15 | 15 | 15 | 15 |
| | | Sulfur | 0.8 | 1.2 | 0.8 | 0.3 | 0.6 | 1.5 | 0.8 | 1.5 | 2 |
| | | NOCCELER TBzTD | 1.2 | 5 | 1.2 | 0.5 | 1 | 5.5 | 1 | 4.5 | 1 |
| | | SANTOCURE-TBSI | 1 | | 1 | 0.5 | 1 | | 1 | | 1 |
| Thermally expandable microcapsule particles | 1 | Average particle diameter: 7.0 μm | | | | | ○ | | | | |
| | 2 | Average particle diameter: 25.5 μm | | | | | | | | | |
| | 3 | Average particle diameter: 3.5 μm | | ○ | | ○ | | ○ | | | |
| | 4 | Average particle diameter: 50.0 μm | ○ | | ○ | | | | ○ | | |
| Solid particles | | Average particle diameter: 20 μm | | | | | | | | ○ | |

TABLE 6

| | | Primary vulcanization | | Secondary vulcanization | | | Mooney viscosity of unvulcanized | Crosslinking starting | Foaming starting |
|---|---|---|---|---|---|---|---|---|---|
| | | Temperature ° C. | Time minutes | Temperature ° C. | Time minutes | UV light irradiation | rubber (100° C.) | temperature (° C.) | temperature (° C.) |
| Comparative Example | 1 | 160 | 30 | 180 | 30 | Absent | 62.4 | 160 | 140 |
| | 2 | 125 | 30 | 180 | 30 | Absent | 60.7 | 125 | 140 |
| | 3 | 160 | 30 | 180 | 30 | Absent | 60.4 | 160 | 140 |
| | 4 | 175 | 30 | 200 | 30 | Absent | 61.5 | 175 | 140 |
| | 5 | 170 | 30 | 185 | 30 | Absent | 61.7 | 170 | 140 |
| | 6 | 125 | 30 | 160 | 30 | Absent | 61.9 | 125 | 140 |
| | 7 | 165 | 30 | 210 | 30 | Absent | 60.1 | 165 | 140 |
| | 8 | 150 | 30 | 170 | 30 | Absent | 60.5 | 130 | — |
| | 9 | 125 | 30 | 180 | 30 | Absent | 60.3 | 150 | — |

In Table 3 and Table 5, "N230SV", "N240S", "N220S", and "N260S" are each the product name of an acrylonitrile-butadiene rubber manufactured by JSR Corporation. SBR (T2003) is the product name of a styrene-butadiene rubber manufactured by Asahi Kasei Chemicals Corporation.

TABLE 7

| | | Average hardness of protrusions ($N/mm^2$) Indentation depth | | Average hardness in elastic layer surface | Average value for diameter of hollow portion | Average shell thickness | Average depth of concave portions |
|---|---|---|---|---|---|---|---|
| | | 1.0 μm | 0.1 μm | ($N/mm^2$) | (μm) | (μm) | (μm) |
| Example | 1 | 1.2 | 8.6 | 2.2 | 28 | 1.35 | 2.2 |
| | 2 | 1.1 | 8.3 | 2.6 | 30 | 2.45 | 1.9 |

TABLE 7-continued

| | Average hardness of protrusions ($N/mm^2$) Indentation depth | | Average hardness in elastic layer surface | Average value for diameter of hollow portion | Average shell thickness | Average depth of concave portions |
|---|---|---|---|---|---|---|
| | 1.0 μm | 0.1 μm | ($N/mm^2$) | (μm) | (μm) | (μm) |
| 3 | 1.2 | 8.6 | 2.2 | 11 | 2.10 | 3.0 |
| 4 | 1.1 | 8.2 | 2.8 | 31 | 2.70 | 2.9 |
| 5 | 1.1 | 8.2 | 2.1 | 18 | 3.00 | 2.8 |
| 6 | 1.1 | 8.5 | 3.2 | 9 | 2.46 | 1.9 |
| 7 | 1.1 | 8.3 | 2.6 | 25 | 2.80 | 1.8 |
| 8 | 1.2 | 8.3 | 2.7 | 100 | 1.15 | 1.8 |
| 9 | 0.8 | 7.7 | 2.0 | 7 | 1.02 | 1.9 |
| 10 | 1.3 | 8.6 | 2.4 | 22 | 1.20 | 1.0 |
| 11 | 1.2 | 8.2 | 2.8 | 10 | 2.55 | 6.0 |
| 12 | 1.4 | 8.1 | 2.3 | 29 | 1.30 | 2.1 |
| 13 | 1.2 | 8.5 | 2.6 | 62 | 0.05 | 1.9 |
| 14 | 1.1 | 8.1 | 2.3 | 78 | 3.00 | 1.8 |
| 15 | 1.1 | 8.0 | 1.9 | 12 | 1.90 | 5.8 |
| 16 | 1.2 | 8.8 | 2.7 | 27 | 1.33 | 2.1 |

TABLE 8

| | | Image evaluation | | | | | |
|---|---|---|---|---|---|---|---|
| | | (Horizontal streak) | | | (Vertical streak) | | |
| | | After 10,000 sheets | After 20,000 sheets | After 30,000 sheets | After 10,000 sheets | After 20,000 sheets | After 30,000 sheets |
| Example | 1 | A | A | A | A | A | B |
| | 2 | A | A | B | A | A | B |
| | 3 | A | A | B | A | A | B |
| | 4 | A | A | B | A | A | B |
| | 5 | A | B | B | A | A | B |
| | 6 | A | B | B | A | A | B |
| | 7 | A | B | B | A | A | B |
| | 8 | B | B | B | A | A | B |
| | 9 | B | B | C | A | A | B |
| | 10 | B | B | C | A | A | B |
| | 11 | A | B | B | A | A | B |
| | 12 | A | A | B | A | A | B |
| | 13 | B | B | B | A | A | B |
| | 14 | B | B | B | A | A | B |
| | 15 | A | A | B | B | B | C |
| | 16 | A | A | A | A | A | A |

TABLE 10

| | | Endurance image evaluation | | | | | |
|---|---|---|---|---|---|---|---|
| | | (Horizontal streak) | | | (Vertical streak) | | |
| | | After 10,000 sheets | After 20,000 sheets | After 30,000 sheets | After 10,000 sheets | After 20,000 sheets | After 30,000 sheets |
| Comparative Example | 1 | D | E | E | B | B | C |
| | 2 | D | E | E | A | A | B |
| | 3 | D | E | E | A | A | B |
| | 4 | D | D | E | B | B | C |
| | 5 | D | D | E | B | B | C |
| | 6 | D | E | E | B | B | C |
| | 7 | D | E | E | A | A | B |
| | 8 | C | D | D | A | A | B |
| | 9 | D | D | D | B | B | C |

As apparent from Table 7 and Table 8, in each of Examples 1 to 16, the image rank after endurance was rank A to C or higher for each of the horizontal streak image and the vertical streak image, i.e., satisfactory images with no problem in practical use were obtained.

TABLE 9

| | | Average hardness of protrusions ($N/mm^2$) Indentation depth | | Average hardness in elastic layer surface | Average value for diameter of hollow portion | Average shell thickness | Average depth of concave portions |
|---|---|---|---|---|---|---|---|
| | | 1.0 μm | 0.1 μm | ($N/mm^2$) | (μm) | (μm) | (μm) |
| Comparative Example | 1 | 1.2 | 8.3 | 1.9 | 120 | 2.70 | 1.5 |
| | 2 | 1 | 7.8 | 2.2 | 5 | 2.95 | 1.2 |
| | 3 | 1.2 | 8.4 | 2.1 | 90 | 3.20 | 1.9 |
| | 4 | 1.9 | 8.1 | 1.8 | 73 | 0.03 | 3.0 |
| | 5 | 1.7 | 8.2 | 1.9 | 22 | 2.60 | 7.0 |
| | 6 | 1.1 | 7.7 | 1.7 | 8 | 2.65 | 0.3 |
| | 7 | 2.1 | 8.3 | 3.9 | 105 | 2.80 | 0.7 |
| | 8 | 3.5 | 8.6 | 2.1 | — | — | — |
| | 9 | — | — | 1.9 | — | — | — |

Meanwhile, as shown in Table 9 and Table 10, in each of Comparative Examples 1, 2, and 7, the average of diameter hollow portions of each of the hollow particles fell outside the range of the present disclosure, and hence polarity reversal by discharge in the hollow portions of the hollow particles was difficult. Thus, the toner adhesion amount increased. Accordingly, discharge between the photosensitive member and the charging roller was nonuniform, and the horizontal streak image rank after 30,000-sheet endurance was rank E.

In Comparative Example 3, the average shell thickness was large, and hence polarity reversal by discharge in the hollow portions of the hollow particles was difficult. Thus, the toner adhesion amount increased.

In Comparative Example 4, the average shell thickness was equal to or lower than the lower limit, and hence convex shapes were difficult to maintain. Accordingly, discharge between the photosensitive member and the charging roller became nonuniform, and the horizontal streak image rank after 30,000-sheet endurance was rank E.

In Comparative Example 5, the average depth of the depressions in the protrusions was large, and it is considered that adhering matter was not able to be eliminated from the depressions to the photosensitive member.

In Comparative Examples 6 and 7, the average depth of the depressions in the protrusions was small, and hence toner pressure contact contamination occurred. Accordingly, discharge resulting from the hollow particles was not sufficient, discharge between the photosensitive member and the charging roller became nonuniform, and the horizontal streak image rank after 30,000-sheet endurance was rank E.

In Comparative Example 8, the solid particles were used, and hence it is considered that contamination remained adhering and accumulated on the protrusions, causing a charging failure. As a result, the horizontal streak image rank after 30,000-sheet endurance was D.

In Comparative Example 9, the particles were not used, and the horizontal streak image rank after 30,000-sheet endurance was rank D.

In each of Examples 2 to 16 and Comparative Examples 1 to 7, it was confirmed by observation with a confocal microscope in the same manner as in Example 1 that a depression was present at the apex portion in each of all 100 points of protrusions exposed at the surface (derived from the hollow particles).

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-088610, filed Apr. 27, 2017, which is hereby incorporated by reference herein in its entirety.

What is claimed is:

1. A charging member, comprising:

an electroconductive support; and an electroconductive elastic layer serving as a surface layer, wherein the elastic layer contains a binder, and holds electrically insulating hollow particles in such a state that at least a part of each of the hollow particles is exposed at a surface of the elastic layer, wherein the charging member has protrusions derived from the hollow particles in an outer surface of the charging member, and the outer surface of the charging member includes an outer surface of the elastic layer and an outer surface of an exposed portion of each of the hollow particles, wherein the hollow particles have an average diameter of hollow portions of each of the hollow particles of 7 μm or more and 100 μm or less, wherein the hollow particles have an average shell thickness of 0.05 μm or more and 3.00 μm or less, wherein the protrusions each have a depression in an outer surface of each of the protrusions, and an edge of the depression constitutes an apex in each of the protrusions, and wherein the depressions have an average depth of 1.0 μm or more and 6.0 μm or less.

2. A charging member according to claim 1, wherein a Martens hardness at an indentation depth of 0.1 μm measured at each of the protrusions is 8.0 $N/mm^2$ or more, and a Martens hardness at an indentation depth of 1.0 μm measured at each of the protrusions is 1.2 $N/mm^2$ or less.

3. A charging member according to claim 1, wherein:

the elastic layer is the only elastic layer of the charging member; and the elastic layer has a thickness of 0.8 mm or more and 4.0 mm or less.

4. A charging member according to claim 1, wherein a Martens hardness at an indentation depth of 1.0 μm measured at the surface of the elastic layer included in the surface of the charging member is 2.0 $N/mm^2$ or more.

5. An electrophotographic process cartridge, comprising at least a charging member, the electrophotographic process cartridge being removably mounted onto a main body of an electrophotographic image forming apparatus, wherein the charging member comprises a charging member including an electroconductive support, and an electroconductive elastic layer serving as a surface layer, wherein the elastic layer contains a binder, and holds electrically insulating hollow particles in such a state that at least a part of each of the hollow particles is exposed at a surface of the elastic layer, wherein the charging member has protrusions derived from the hollow particles in an outer surface of the charging member, and the outer surface of the charging member includes an outer surface of the elastic layer and an outer surface of an exposed portion of each of the hollow particles, wherein the hollow particles have an average diameter of hollow portions of each of the hollow particles of 7 μm or more and 100 μm or less, wherein the hollow particles have an average shell thickness of 0.05 μm or more and 3.00 μm or less, wherein the protrusions each have a depression in an outer surface of each of the protrusions, and an edge of the depression constitutes an apex in each of the protrusions, and wherein the depressions have an average depth of 1.0 μm or more and 6.0 μm or less.

6. An electrophotographic image forming apparatus, comprising at least a charging member, an exposing apparatus, and a developing apparatus, wherein the charging member comprises a charging member including an electroconductive support, and an electroconductive elastic layer serving as a surface layer, wherein the elastic layer contains a binder, and holds electrically insulating hollow particles in such a state that at least a part of each of the hollow particles is exposed at a surface of the elastic layer, wherein the charging member has protrusions derived from the hollow particles in an outer surface of the charging member, and the outer surface of the charging member includes an outer surface of the elastic layer and an outer surface of an exposed portion of each of the hollow particles, wherein the hollow particles have an average diameter of hollow portions of each of the hollow particles of 7 μm or more and 100 μm or less, wherein the hollow particles have an average shell thickness of 0.05 μm or more and 3.00 μm or less, wherein the protrusions each have a depression in an outer surface of each of the protrusions, and an edge of the depression constitutes an apex in each of the protrusions, and wherein the depressions have an average depth of 1.0 μm or more and 6.0 μm or less.

* * * * *